US006461247B1

(12) United States Patent
Riddell

(10) Patent No.: US 6,461,247 B1
(45) Date of Patent: Oct. 8, 2002

(54) GOLF PUTTING PRACTICE APPARATUS

(76) Inventor: James Douglas Riddell, 16839 W. 55'th Dr., Golden, CO (US) 80403

( * ) Notice: Subject to any disclaimer, the term of this patent is extended or adjusted under 35 U.S.C. 154(b) by 0 days.

(21) Appl. No.: 09/490,446

(22) Filed: Jan. 24, 2000

Related U.S. Application Data

(60) Provisional application No. 60/115,960, filed on Feb. 15, 1999.

(51) Int. Cl.[7] ..... A63B 57/00; A63B 53/06; A63B 53/16; A63B 69/36

(52) U.S. Cl. ..... 473/219; 473/162; 473/164; 473/236; 473/265

(58) Field of Search ..... 273/317.2; 473/131–137, 473/219–225, 162, 163, 184, 236–238, 252, 200, 251, 257, 261–265, 229; D21/791, 466; 73/65.02, 12.02; 436/2, 49; 434/252

(56) References Cited

U.S. PATENT DOCUMENTS

| | | | | | |
|---|---|---|---|---|---|
| 1,545,648 | A | * | 7/1925 | Fletcher | 473/218 |
| 4,230,319 | A | * | 10/1980 | Lindner | 473/265 |
| 4,368,888 | A | * | 1/1983 | Ren | 473/164 |
| 4,413,826 | A | * | 11/1983 | Miller | 473/265 |
| 4,620,708 | A | * | 11/1986 | Meyer et al. | 473/265 |
| RE32,397 | E | * | 4/1987 | Self et al. | 473/229 |
| 4,832,344 | A | * | 5/1989 | Werner | 473/244 |
| 5,011,154 | A | * | 4/1991 | Bowen | 473/265 |
| D325,419 | S | * | 4/1992 | Mulloy | D21/791 |
| 5,135,228 | A | * | 8/1992 | Hawkins, Sr. et al. | 473/236 |
| 5,209,484 | A | * | 5/1993 | Randall | 473/265 |
| 5,246,233 | A | * | 9/1993 | Sheltman et al. | 473/265 |
| 5,551,695 | A | * | 9/1996 | Wolk | 473/236 |
| 5,595,543 | A | * | 1/1997 | Wolk | 473/162 |
| 5,720,667 | A | * | 2/1998 | Tu | 473/162 |
| 6,152,830 | A | * | 11/2000 | Archie | 473/162 |
| 6,248,022 | B1 | * | 6/2001 | Steyn | 473/164 |

* cited by examiner

*Primary Examiner*—Paul T. Sewell
*Assistant Examiner*—Mitra Aryanpour
(74) *Attorney, Agent, or Firm*—G. F. Gallinger

(57) ABSTRACT

A golf putting practice apparatus for improving one's stroke and accuracy in putting a golf ball with a putter, comprising: two cord positioning and holding members, each member having an inner face portion, and adapted to hold portions of the length of cord in spaced parallel linear alignment between the members; and, a length of cord extending between the two inner face portions of the cord holding and positioning members. The golf ball may be initially positioned and subsequently putted between the parallel portions of the cord; thereby enabling one to better judge the linearity of the stroke of the putter and the accuracy of the putt by reference to the portions of the cord held in parallel and spaced alignment on each side of the ball. A method of using the above apparatus is disclosed which includes the step of applying two strips of colored tape to top portions of the putter in a position which vertically corresponds to the position of the cord therebelow. The strips of tape facilitate judging the linearity of a putting stroke.

11 Claims, 1 Drawing Sheet

GOLF PUTTING PRACTICE APPARATUS

PROVISIONAL APPLICATION

Figure 1:
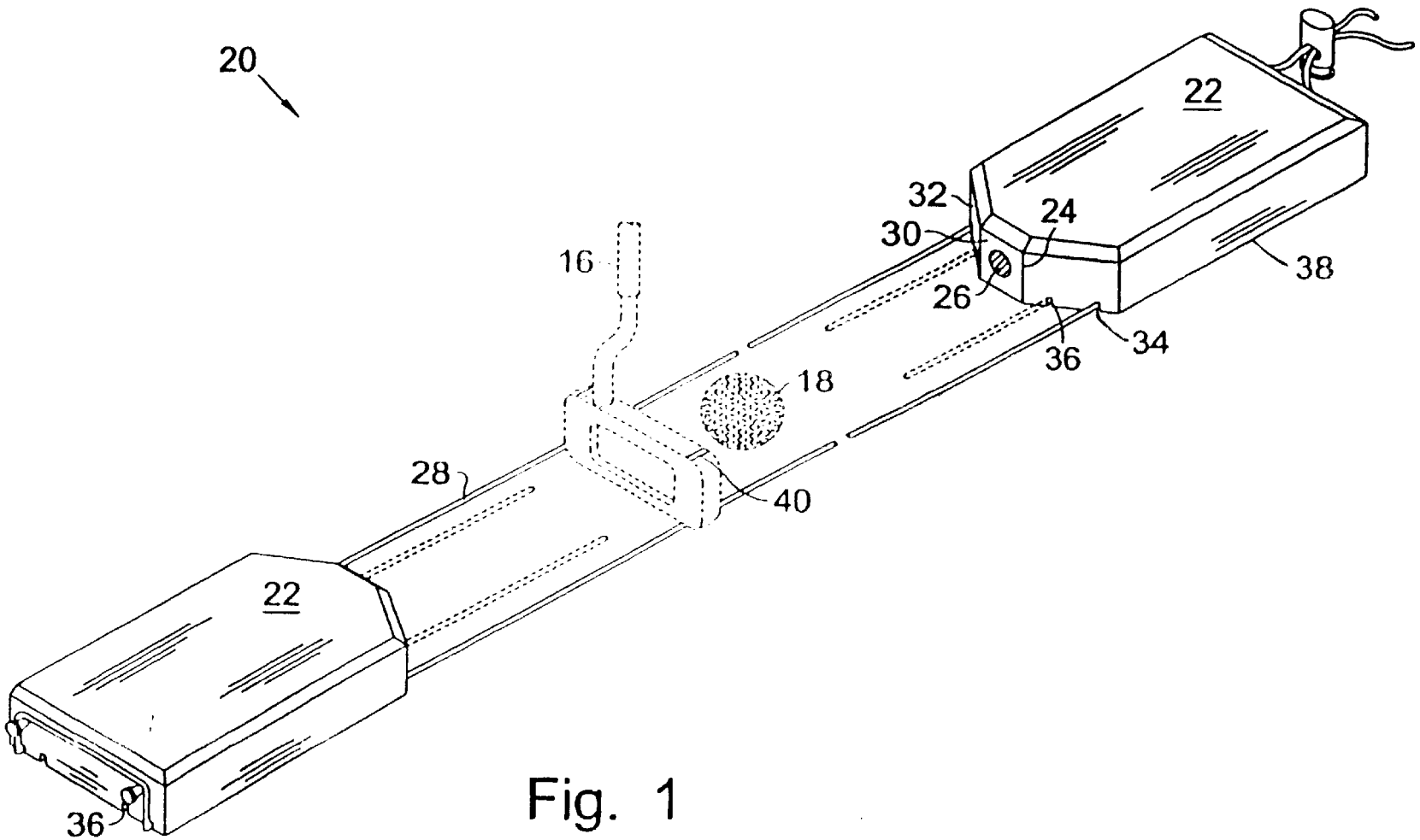

This application is filed subsequent to provisional application, Ser. No. number 60/115,96 filed Jan. 15, 1999, entitled "Golfers Putting Training and Practice Device". The filing date of the provisional application is claimed.

FIELD OF THE INVENTION

This invention relates to golf training and practice equipment. More particularly this invention relates to a golf putting practice apparatus which can be alternatively used on carpet in an office or on grass out-of-doors.

BACKGROUND OF THE INVENTION

The applicant is a golfer. To improve the form of his putting stroke, and the accuracy of his putting he has devised a portable apparatus which can be readily laid out on the carpet of an office; or alternatively, laid down out-of-doors on grass or even over a hole on a green. The apparatus allows him to swing freely without any restraints. It does not have rigid side portions. On longer putts he can elevate his club at the end of a stroke. On both long and short shots he is able to more accurately judge the linearity of his follow through.

He has designed the apparatus so that it can be used in two opposite directions, so that a golfer can first put to one end of the apparatus, and then after walking to the opposite end to retrieve his ball; he can putt back to the direction where he started. The apparatus is also arranged so that the golfer may readily shorten or elongate the apparatus to practice varying distances of putts. The apparatus can be extended to take full advantage of all of his office length for putting a maximum distance. After the apparatus has been used, it may be picked up, and inserted into a golf bag for transport and storage.

OBJECTS OF THE INVENTION

It is an object of this invention to disclose a golf putting and training apparatus. It is an object of this invention to disclose an apparatus which may be alternatively used on the carpet of an office, or over a cup on the green of a golf course. It is yet a further object of this invention to disclose an apparatus which is really portable. The apparatus may be readily laid out and quickly lifted. The apparatus is so small that it may be stored and transported in a golf bag. It is yet a further object of this invention to disclose an apparatus which may be sized for either short or long shots. An apparatus which does not in any way restrain a golfer's stroke, but yet does allow a-golfer to better judge the linearity of his forward and backward stroke. It is a final object of this invention to disclose an apparatus which allows a golfer to readily and unerringly determine if his putt was sufficiently accurate to fall into a cup.

One aspect of this invention provides for a golf putting practice apparatus for improving one's stroke and accuracy in putting a golf ball with a putter, comprising: two cord positioning and holding members, each member having an inner face portion, adapted to hold portions of the length of cord in spaced parallel linear alignment between the members; and, a length of cord extending between the two inner face portions of the cord positioning and holding members. The golf ball may be initially positioned and subsequently putted between the parallel portions of the cord; thereby enabling one to better judge the linearity of a stroke of the putter and the accuracy of the putt by reference to the portions of the cord held in parallel and spaced alignment on each side of the ball.

A preferred aspect of this invention comprises a method using the above apparatus and includes the step of applying two strips of colored tape on a top portion of the putter in a position which vertically corresponds to the position of the cord therebelow to facilitate judging follow through in a stroke of the putter. When the golf ball is putted towards a cord positioning and holding member with a putter, the trajectory of the golf ball and the putter with respect to the cord may be observed.

Various other objects, advantages and features of this invention will become apparent to those skilled in the art from the following description in conjunction with the accompanying drawings.

FIGURES OF THE INVENTION

FIG. 1 is a perspective view of a golf putting practice apparatus showing a golf ball and putter in practice position.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a golf putting practice apparatus 20 showing a golf ball 18 and putter 16 in practice position. The golf putting practice apparatus 20 facilitates improving one's stroke with the putter 16 and improving accuracy in putting the golf ball 18. The apparatus 20 comprises two cord positioning and holding members 22. Each cord positioning and holding member has an inner face 24. The members 22 are adapted to hold a length of cord 28 in a linear position therebetween.

When the golf ball 18 is putted parallel to the cord 28 away from one cord positioning and holding member 22 towards the inner face 24 of the other cord positioning and holding member 22; the linearity of the stroke of the putter 16, and the accuracy of the direction of the putt may be better judged by reference to the cord 28.

Most preferably the cord holding and positioning members 22 are adapted to hold portions of the length of cord 28 in spaced parallel linear alignment between the members 22. The golf ball 18 may then be initially positioned and subsequently putted between the parallel portions of the cord 28. This use of parallel portions of a length of cord 28 enables one to better judge the linearity of the stroke of the putter 18 and the accuracy of the putt by reference to the portions of the cord 28 which is held in parallel and spaced alignment on each side of the ball 18.

Most preferably the inner face portions 24 of the cord positioning and holding members 22 are provided with a target 26 centrally positioned thereon to aim the golf ball 18 at. Both of the cord positioning and holding members 22 are provided with targets 26 to allow practice in both directions. In a preferred embodiment of the invention, a central portion 30 of the inner face portion 24 of the cord positioning and holding members 22 is generally perpendicular to the portions of the cord 28 extending therebetween, and the lateral edge portions 32 adjacent to the central portion 30 on the inner face portion 24 of the cord positioning and holding members 28 are obtusely outwardly sloped with respect to the cord 28; so that if the ball 18 strikes the central portion 30 having the target 26 thereon the ball 18 will be reflected back parallel to the cord 28. However, if the ball 18 strikes a lateral edge portion 32 missing the target 26, the ball 18 will be deflected outwardly indicating that the target 26 was missed. The relative widths of the central 30 and lateral edge portions 32 of the inner face portion 24 are selected to result in the ball 18 being reflected parallel to the cord 28, if and only if the putt would have had accuracy sufficient to allow the ball 18 to drop into a cup (not shown).

In the preferred embodiment of the invention the cord positioning and holding members 22 comprise blocks each having a pair of grooves 34, open from a bottom side portion 38 thereof to position and hold the cord 28. The grooves 34 are adapted to hold the cord 28 marginally above ground level so that if the putter 16 strikes the ground level while practicing, then the cords 28 shift signalling the error.

Most preferably the portions of the cord 28 which are held in spaced linear alignment form a narrow track, narrower than the diameter of a golf cup (not shown). A second pair of grooves 36 on each positioning and holding member 22 may be added to more narrowly space the parallel portions of the cord 28 for more practiced individuals.

A method of practicing and improving one's golf putting skills comprising the following steps: Extending a cord 28 between the inner faces 24 of two cord positioning and holding members 22. Positioning the two members 22 so that the cord is held linearly between the inner faces 24, ascertaining that the inner faces 24 are each generally perpendicular to the length of cord 28 extending therebetween. Positioning a golf ball 18 adjacent to the cord 28 and putting the golf ball 18 along parallel to the cord 28 towards a cord positioning and holding member with a putter 16. And finally, observing the trajectory. of the golf ball 18 and the putter 16 with respect to the cord 28.

A preferred method further comprises the additional step of applying a strip of colored tape 40 on a top portion of the putter 16 in a position which vertically corresponds to the position of the cord 28 therebelow to facilitate judging follow through in a stroke of the putter 16.

In a yet more preferred method the two cord positioning and holding members 22 are each provided with two spaced grooves 34 in a bottom side portion 38 thereof and the cord 28 is extended back and forth between the two cord positioning and holding members delineating a track between the portions of the cord therebetween. The golf ball 18 is initially positioned between the portions of the parallel cord 28 within the track and, two strips of colored tape 40 are applied to top portions of the putter 16 in a position which vertically corresponds to the position of the cord 28 therebelow to facilitate judging the linearity in a putting stroke of the putter 18.

While the invention has been described with preferred specific embodiments thereof, it will be understood that this description is intended to illustrate and not to limit the scope of the invention, which is defined by the following claims.

I claim:

1. A golf putting practice apparatus for improving one's stroke and accuracyy in putting a golf ball with a putter, comprising:

two cord positioning and holding members, each member having two spaced grooves in a bottom side portion, and each member having an inner face having a lower edge portion, and wherein the two said grooves in the bottom side portion of each member each extend through the lower edge portion of the inner face portions thereof;

a cord, having sufficient length to extend along the grooves and extend back and forth between the grooves in the two cord positioning and holding members;

so that when the two members are spaced apart with the cord extending generally linearly and perpendicularly between the inner faces, and when a golf ball is positioned adjacent to and between the cords;

then when targeting the golf ball to strike the inner face of one cord positioning and holding member, the putter may swing unobstructed over the lengths of cords and the trajectory of the golf ball and the putter with respect to the lengths of cord can be observed.

2. An apparatus as in claim 1 wherein the inner face portions of the cord positioning and holding members are provided with a target centrally positioned thereon to aim the golf ball at.

3. An apparatus as in claim 2 wherein the central portion of the inner face portion of the cord positioning and holding members is generally perpendicular to the cord extending therebetween and wherein lateral edge portions adjacent to the central portion on the inner face portion of the cord positioning and holding members are sloped with respect to the cord;

so that if the ball strikes the central portion having the target thereon the ball will be reflected back parallel to the cord;

whereas if the ball strikes a lateral edge portion missing the target, the ball will be deflected outwardly indicating that the target was missed.

4. An apparatus as in claim 3 wherein the relative widths of the central and lateral edge portions of the inner face portion are selected to result in the ball being reflected parallel to the cord, if and only if the ball is putted generally parallel to the cord.

5. An apparatus as in claim 1 wherein the cord positioning and holding members comprise wooden blocks.

6. An apparatus as in claim 5 wherein the cord positioning and holding members are adapted to hold the parallel lengths of cord marginally above ground level so that if the putter strikes the ground level while practicing, then one of the parallel lengths of cord shifts signalling the error.

7. An apparatus as in claim 6 wherein portions of the cord are held in spaced linear alignment forming a narrow track, narrower than the diameter of a golf cup.

8. An apparatus as in claim 7 wherein there are a second pair of grooves on each cord positioning and holding member so that the spacing of the parallel portions of the cord may be widened for less practiced individuals.

9. method of practicing and improving one's stroke and accuracy in putting a golf ball with a putter, comprising the following steps:

providing two cord positioning and holding members, each member having two spaced grooves in a bottom side portion, and wherein each member having an inner face having a lower edge portion, and wherein the two said grooves in the bottom side portion of each member each extend through the lower edge portion of the inner face portions thereof;

positioning and holding a cord within the grooves, and extending the cord back and forth between the grooves in the two cord positioning and holding members positioning the two members so that the lengths of cord therebetween are held parallel to each other and linearly between the inner faces, and the inner faces are each generally perpendicular to the lengths of cord extending therebetween;

positioning a golf ball adjacent to and between the cords so that the putter may swing unobstructed over the lengths of cords when the ball is putted;

putting the golf ball with the putter along a trajectory generally parallel to the cords, targeted to strike the inner face of one cord positioning and holding member; and finally, observing the trajectory of the golf ball and the putter with respect to the lengths of cord.

10. A method as in claim 9 further comprising the step of applying a strip of colored tape on a top portion of the putter in a position which vertically corresponds to the position of the cord therebelow to facilitate judging follow through in a stroke of the putter.

11. A method as in claim 10 wherein two strips of colored tape are applied to top portions of the putter in a position which vertically corresponds to the position of the cord therebelow to facilitate judging the linearity in a stroke of the putter.

* * * * *